US005143654A

United States Patent [19]

Kikuchi et al.

[11] Patent Number: 5,143,654

[45] Date of Patent: Sep. 1, 1992

[54] METHOD AND APPARATUS FOR SOLIDIFYING RADIOACTIVE WASTE

[75] Inventors: Makoto Kikuchi; Masato Ohura, both of Hitachi; Shin Tamata, Higashiibaraki; Koichi Chino, Hitachi; Kiyomi Funabashi, Katsuta, all of Japan

[73] Assignee: Hitachi, Ltd., Tokyo, Japan

[21] Appl. No.: 581,904

[22] Filed: Sep. 13, 1990

[30] Foreign Application Priority Data

Sep. 20, 1989 [JP] Japan ..... 1-243671

[51] Int. Cl.[5] ..... G21F 9/16

[52] U.S. Cl. ..... 252/629; 252/628; 252/626

[58] Field of Search ..... 252/626, 628, 629

[56] References Cited

U.S. PATENT DOCUMENTS

| | | | |
|---|---|---|---|
| 3,838,061 | 9/1974 | Cuaz et al. | 252/626 |
| 3,988,258 | 10/1976 | Curtiss et al. | 252/626 |
| 4,010,108 | 3/1977 | Grabhn et al. | 252/626 |
| 4,432,894 | 2/1984 | Kamiya et al. | 252/632 |
| 4,444,680 | 4/1984 | Kitzes et al. | 252/632 |
| 4,534,893 | 8/1985 | Dippel et al. | 252/629 |
| 4,629,587 | 12/1986 | Monden et al. | 252/628 |

OTHER PUBLICATIONS

Duffy, J. I., "Treatment, Recovery, and Disposal Processes for Radioactive Waste", 1983, pp. 14–20.

Technical Report "Safety Assessment of the Radioactive Waste-Cement Composites", S. Emura et al., Jun. 28, 1974.

*Primary Examiner*—Brooks H. Hunt
*Assistant Examiner*—Ngoclan T. Mai
*Attorney, Agent, or Firm*—Fay, Sharpe, Beall, Fagan, Minnich & McKee

[57] ABSTRACT

A method of solidifying a radioactive waste of an atomic power plant, for example, begins with concentrating the liquid waste to powder or pellet form to reduce its volume. Prior to reducing its volume, an estimation is made of what the concentration will be once the liquid waste is converted into powdered or pelletized form. The powdered or pelletized waste is charged into a container, and a solidifying agent is poured over the contents to form a solidified body. The solidifying agent is prepared to have a desired coefficient of distribution that is determined in accordance with the estimated concentration of the reduced volume solidified waste so that the amount of leaching of the solidified body that is produced will be less than or equal to a predetermined value, such as the known value of leaching for a conventional cement-solidified waste that is not processed to reduce its volume before being solidified.

15 Claims, 2 Drawing Sheets

METHOD AND APPARATUS FOR SOLIDIFYING RADIOACTIVE WASTE

BACKGROUND OF THE INVENTION

1. FIELD OF THE INVENTION

The present invention relates to a method and apparatus for solidifying radioactive waste by using a solidifying agent capable of sealing radioactive waste that has been processed to reduce its volume. In particular, the solidified radioactive nuclides present in the waste have a long half life, and after being solidified must be prevented from being released into the environment, such as into the ground water, by leaching.

2. DESCRIPTION OF RELATED ART

Concentrated radioactive liquid waste and radioactive resin slurry waste are produced in an atomic power plant. Conventionally, the radioactive waste, which typically has a 20 percent solids content, is solidified as it is with cement in a container to form a solidified radioactive waste. Recently, attempts have been made to solidify a concentrated liquid waste or slurry that has been dried to form a powder that is granulated or pelletized with cement Further, attempts are being made to solidify liquid wastes that have been concentrated into the form of a sludge by mixing the sludge with a solidifying agent in a container.

In Japan, a final disposal system for solidified radioactive wastes has been established. The plan, which is to by fully implemented in 1991, focuses on land as the area in which the radioactive waste will be finally disposed. The standards for implementing the plan are being prepared, and Table 1 shows one of the standards, Sub-section 3 of Section 13 of the Enforcement Ordinance on the Regulations of Nuclear source Material, Nuclear Fuel Material and Reactor (Section 324 of Government Ordinance, Nov. 21, 1957; amended on Mar. 17, 1987). The table shows the maximum allowable levels of radioactive concentration that are permitted for solidified radioactive wastes.

TABLE 1

| | | |
|---|---|---|
| Wastes generated in facilities or plants with reactor installed, and solidified in a container. | Carbon 14 | 1 Ci/t |
| | Cobalt 60 | 300 Ci/t |
| | Nickel 63 | 30 Ci/t |
| | Strontium 90 | 2 Ci/t |
| | Cesium 137 | 30 Ci/t |
| | Radioactive substance radiating α rays | 0.03 Ci/t |

In this table, the radioactive nuclide concentrations are regulated with respect to carbon 14 (hereinafter referred to as "C-14"), cobalt 60 (hereinafter referred to as "Co-60"), nickel 63 (hereinafter referred to as "Ni-63"), strontium 90 (hereinafter referred to as "Sr-90"), cesium 137 (hereinafter referred to as "Cs-137") and a substance radiating o radiation (hereinafter referred to as "α waste").

In the industry, there is a desire to concentrate the radioactive waste to its highest permitted level in order to reduce the space needed for the long term storage of the waste. As the radioactive concentration of the waste is increased, however, there exists a possibility that the amount of leaching of the solidified waste will also be increased. Therefore, many attempts are being made to solidify the radioactive waste as it is or after concentrated so that the amount of leaching for such a solidified waste does not exceed levels of leaching that are considered by the industry to be permissible.

SUMMARY OF THE INVENTION

According to the conventional practice, a solidifying agent for solidifying a radioactive waste is selected on the basis of its mechanical properties, such as its material strength and fire resistance. Thus, the effect of a particular solidifying agent on the amount of leaching of the solidified waste has not been adequately considered. Although final disposal facilities for radioactive waste are designed to have an artificial barrier layer of a material such as bentonite to absorb leached radioactive substances, it is more desirable to suppress the amount of leaching for a concentrated solidified radioactive waste that might occur during storage of the waste. It is an object of the invention, therefore, to suppress the amount of leaching that occurs for a concentrated solidified radioactive waste so that the solidified radioactive waste can be stored over a long period of time without contaminating the environment.

According to the present invention, a radioactive liquid waste that is to be solidified with a solidifying agent in a container is concentrated to reduce its volume, and consequently to increase its radioactive concentration. On the other hand, conventional solidified radioactive waste (herein referred to as "conventional cement-solidified waste") is obtained by solidifying a concentrated radioactive liquid waste or a radioactive resin slurry waste with conventional cement in a container, without first processing the waste to reduce its volume. The radioactive concentration of the waste processed according to the present invention has a significantly increased concentration in comparison with that of the conventional cement-solidified waste, but it is still within the allowable levels presently permitted. By increasing the radioactive concentration, however, the amount of leaching of the solidified waste has a tendency of increasing. Therefore, although the volume of the waste being solidified is reduced, this results in a consequent increase in radioactive concentration and a tendency for the amount of leaching of the solidified body to increase.

In order to suppress the amount of leaching of a solidified waste having a high volume reduction ratio in comparison to that of a conventional cement-solidified waste, it is necessary to enhance the radioactive substance's adsorbability of the solidifying agent to a greater extent than that of the conventionally used solidifying agent. For example, if the volume reduction ratio of the radioactive waste is twice that of a conventional cement-solidified waste, it is necessary to increase the radioactive substance's adsorbability of a solidifying agent to twice that or more of a conventional solidifying agent to make the amount of leaching equal to or smaller than that of the conventional cement-solidified waste of the same quantity and stored under the same conditions.

According to the present invention, it has been determined that the radioactive substance's adsorbability of a solidifying agent relates to the distribution coefficient of the solidifying agent. The distribution coefficient of the solidifying agent is adjusted according to the result of an estimation that is made before the waste is concentrated of what the concentration will be after the waste is concentrated. The adjustment is made by considering the distribution coefficient for a plurality of solidifying agent components, and then making a solidifying agent from one or more of the agent components in accordance with the estimation of the concentration of the waste so that the amount of leaching of the solidified radioactive waste is decreased with respect to that of a predetermined value, such as the amount of leaching that is known to occur for a radioactive waste that has not been concentrated (processed to reduce its volume) and has been solidified with only cement to produce a solidified body (conventional cement-solidified waste) of an equivalent quantity.

The distribution coefficients of the solidifying agent components that are considered depend on the type of radioactive substance present in the waste to be solidified, and it is therefore desirable to select a solidifying agent on the basis of the noticeable nuclides in a waste that is to be solidified. There are many types of radioactive nuclides in radioactive wastes of an atomic power plant. Preferably, the types of radioactive nuclides present in a radioactive waste to be solidified are known.

According to the invention, the solidifying agent is made from one or more of a plurality of solidifying agent components. Each agent component has a different distribution coefficient with respect to a particular radioactive nuclide. The agent components are mixed in an appropriate mixing ratio in accordance with what the concentration of the waste will be after it is processed to reduce its volume, and so that the amount of leaching from the radioactive waste after it is solidified is reduced to the amount equivalent to or smaller than that of a conventional cement-solidified waste of the same quantity and having the same types of radioactive nuclides present in the waste. It is an object of the invention, therefore, to decrease the amount of leaching of a solidified radioactive waste that has been processed to reduce its volume before being solidified so that the amount of leaching is less than that permitted by a maximum allowable level set by an ordinance, for example, and/or less than or equal to that of a conventional cement-solidified waste that has not been preprocessed to reduce its volume before solidification.

BRIEF SUMMARY OF THE DRAWING

Further objects, features and advantages of the present invention will be understood from the following Detailed Description of a Preferred Embodiment, as shown in the accompanying drawing, wherein.

DETAILED DESCRIPTION OF THE PREFERRED EMBODIMENTS

An embodiment of the present invention will be explained with reference to FIGS. 1 and 2. In this embodiment, a concentrated radioactive liquid waste, such as a radioactive waste generated from an atomic power plant, is dried into the form of a powder, and then granulated into pellets. The pellets are charged into a container and solidified by a solidifying agent that is poured into the container to cover the pellets.

Figure 1:
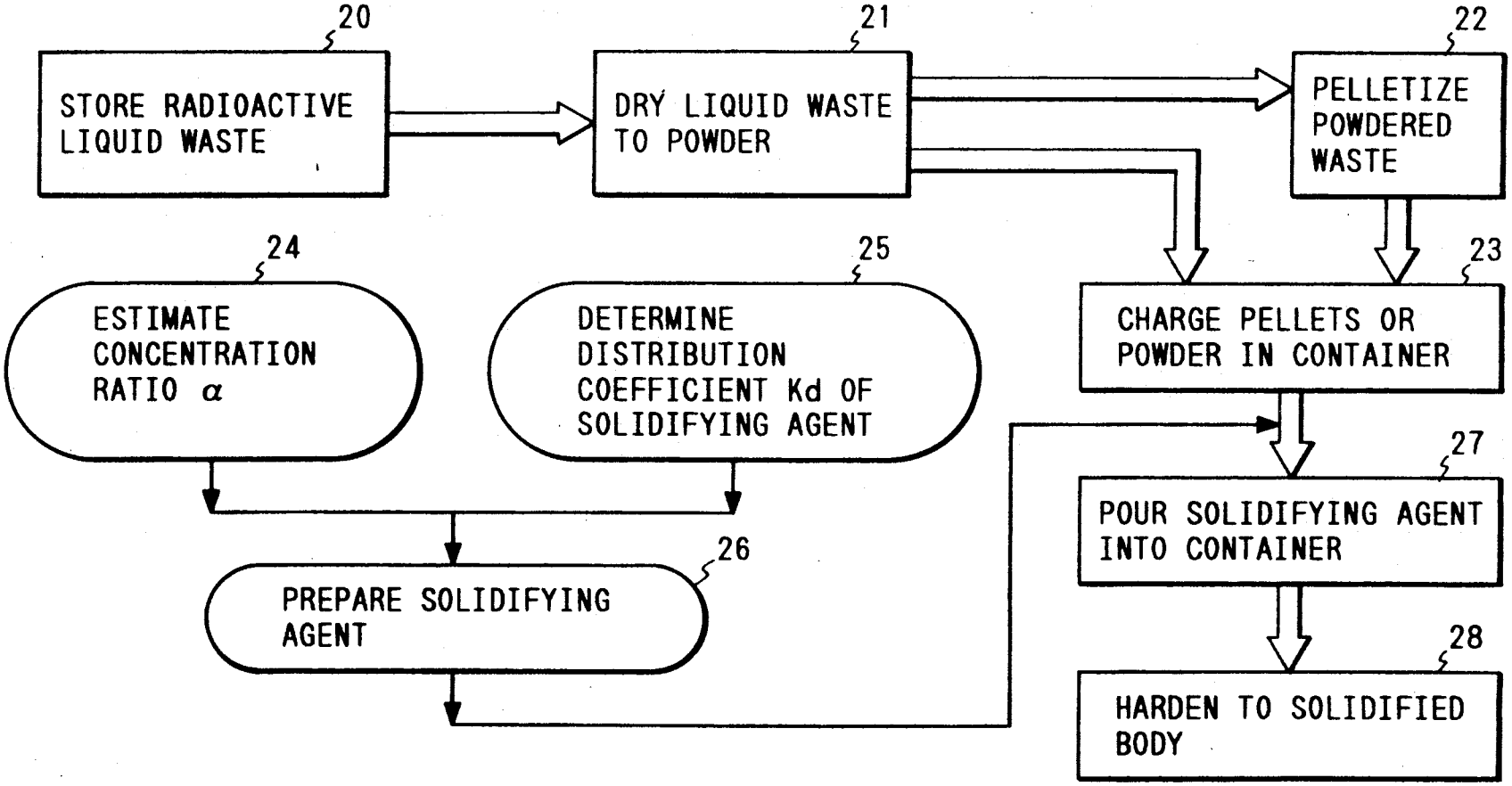
FIG. 1 is a flowchart of an embodiment of the process of the invention.
Figure 2:
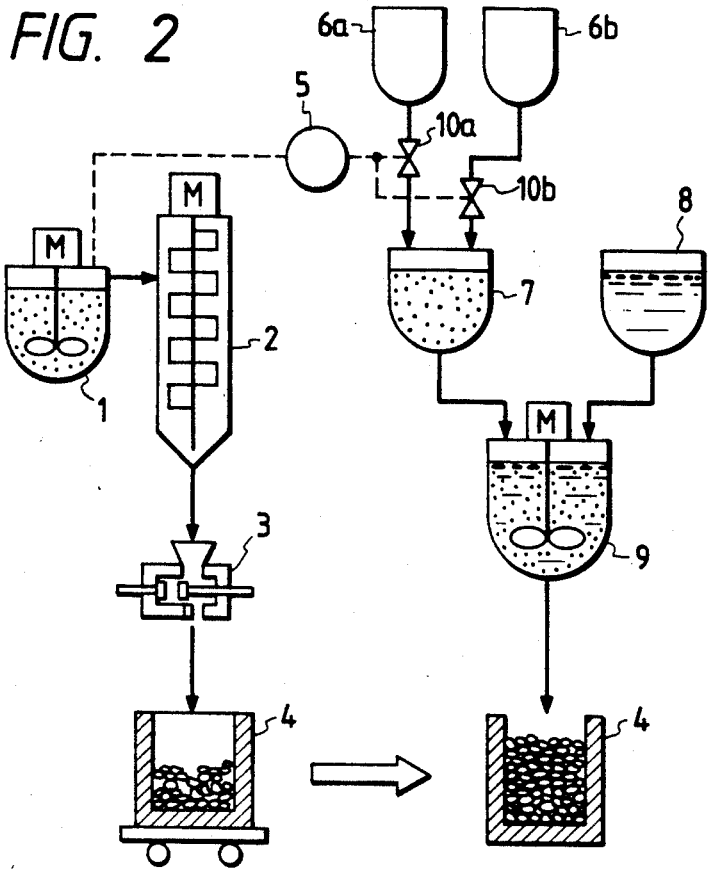
FIG. 2 is a schematic representation of an apparatus for performing an embodiment of the process of the present invention.

A flowchart of the process of an embodiment of the invention is shown in FIG. 1. FIG. 2 shows a schematic representation of an apparatus for performing the process. In a first step 21, radioactive liquid waste from an atomic power plant, for example, preferably having radioactive nuclide(s) of known type is stored in a tank 1. The liquid waste is transferred from tank 1 to dryer 2, which may be a centrifugal thin-film dryer, for example. In step 21 the liquid waste is concentrated by drying it in dryer 2 to form a powder. It is preferred that the powder is further pelletized in a pelletizer 3 in a step labeled 22 in FIG. 1. Thereafter, the pellets are charged in container 4, as shown in step 23. Alternatively, as shown in step 23 in FIG. 1, the dried powdered waste can be charged in container 4 without the intermediate step of pelletizing.

In accordance with the present invention, a solidifying agent is introduced into container 4 for solidifying the pelletized waste. In preparing the solidifying agent, first a concentration ratio o is determined in step 24. The concentration ratio o is determined by estimating what the concentration of the radioactive liquid waste will be with respect to its present state after concentrating the waste by drying it in dryer 2 and converting it into powder or pellet form for charging it in container 4. The distribution coefficient Kd of the solidifying agent is then determined on the basis of the estimated concentration ratio $\alpha$ in step 25. The solidifying agent with the desired distribution coefficient Kd is prepared in step 26 from one or more of a plurality of solidifying agent components selected according to the type of radioactive substances present in the waste and based upon each solidifying agent component's coefficient of distribution with respect to the type of radioactive substances present in the waste. In FIG. 2, for example, two solidifying agent components are shown as being contained in tanks **6*a* and 6*b*, respectively. The mixture of these solidifying agent components is controlled by a controller 5 in accordance with the desired distribution coeffioient Kd. Controller 5 controls the opening and closing of valves 10*a* and 10*b*, respectively, to deliver the appropriate proportions of the solidifying agent components from tanks 6*a* and 6*b* into solidifying agent tank 7. Then, the solidifying agent 7 is mixed with water from tank 8 in a mixing tank 9. The solidifying agent in tank 9 is then poured into the container 4 in step 27, and thereafter the contents of container 4 are hardened to a solidified body in step 28**. After hardening, a final solidified waste is obtained.

The final solidified waste contains approximately 8 to 10 times as great an amount of radioactive substances as a conventional cement-solidified waste having the same solidified volume because the conventional cement-solidified waste is produced merely by solidifying a radioactive liquid waste with cement in a container as it is without subjecting the waste to prior volume-reduction processing. Therefore, the container of solidified waste reduced according to the present invention has an 8 to 10 times greater radioactive concentration than that of the conventional cement-solidified waste of the same quantity.

Table 2 shows the measured value of the distribution coefficient of each solidifying agent component with respect to the ions of a plurality of radioactive nuclides found in the radioactive waste of an atomic power plant.

TABLE 2

Measured Value of Distribution Coefficient of Solidifying Agent Components with Respect to Nuclides (Saturated $Na_2SO_4$ solution, 25° C.)

| | Solidifying agent ml/g | | | | | |
|---|---|---|---|---|---|---|
| Ion | Cement | Sodium silicate | Zeolite | Bentonite | Calcium*[1] salt | Oxine-added charcoal |
| Cs | 1 | 90 | 20 | 100 | 50 | 1 |
| C | 70 | 10 | 0 | 0 | 500 | — |
| Co | 930 | 600 | 50 | 20 | 50 | 27000 |
| Sr | 20 | 4300 | — | 5 | 50 | 300 |
| Ni | 2000 | 2000 | 50 | 20 | 50 | 27000 |
| α waste | 2000 | 2000 | — | 200 | — | — |

*[1]calcium hydroxide
—: no measured data

The measurement of a distribution coefficient is explained with reference to the following example. Assuming that a concentrated radioactive liquid waste is a regenerated liquid waste of a desalting ion exchange resin (the main ingredient thereof being $Na_2SO_4$) generated from an atomic power plant, 50 ml of saturated aqueous $Na_2SO_4$ solution is charged into the tank. To this solution are added 0.01 μCi/ml of the ions of one of the six nuclides shown in Table 2 and thereafter 1 g of the articles of one of the solidifying agent components shown in Table 2 obtained by pulverizing the solidified component. After the elapse of time sufficient for reaching the adsorption equilibrium, the solution is separated from the solidifying agent component, and the concentration (μCi/ml) of the nuclide in the solution and the concentration (μCi/g) of the nuclide in the solidifying agent component are measured by X-ray measurement. The value obtained by dividing the measured value of the latter concentration by the measured value of the former concentration is the distribution coefficient with respect to the solidifying agent component. The distribution coefficient varies greatly in accordance with different radioactive nuclides and solidifying agent components.

In the present invention, the composition of the solidifying agent is adjusted to obtain the desired distribution coefficient according to the concentration of the radioactive nuclide of a solidified radioactive waste having its volume reduced so that the amount of leaching of the solidified waste is equal to or smaller than that of a conventional cement-solidified waste of the same type and quantity. The solidifying agent comprises one or more of the solidifying agent components shown in Table 2. To determine the most effective solidifying agent component or mixture of components in preparing the solidifying agent, the various distribution coefficients shown in Table 2 are noted with respect to the type of radioactive substance contained in the waste to be solidified. An analysis of the considerations involved in preparing the desired solidifying agent is discussed as follows.

Any given nuclide of the six nuclides shown in Table 2 is selected as a noticeable nuclide represented by j, and any given solidifying agent component shown in Table 2 is represented by k. The distribution coefficient of k with respect to j is represented by $Kd_{jk}$.

In the preparation of the solidifying agent, two cases are considered. In the first case, a single solidifying agent component is used for solidifying the radioactive waste. In the second case, a solidifying agent comprising a plurality of mixed solidifying agent components is used to solidify the radioactive waste.

(1) The case of using a single solidifying agent component

Let the amount of nuclide leached from a solid body be $$\propto \frac{C_j}{Kd_{jk}} \tag{1}$$

wherein $C_j$ represents the concentration of the nuclide j in the solid waste. The intended condition is (the amount of radioactive nuclide $j$ leached from a conventional cement-solidified waste) ≧ (the amount of radioactive nuclide $j$ leached from a solidified waste produced by solidifying a concentrated liquid waste dried into the form of a powder or further pelletized so as to reduce its volume with a solidifying agent $k$) (2)

If the concentration ratio of the radioactive nuclide j powdered or further pelletized from its original state as a liquid waste is $\alpha_j$, formula (2) is represented as follows:

$$\frac{C_j}{Kd_{j1}} \geqq \frac{\alpha_j C_j}{Kd_{jk}} \tag{3}$$

That is, $$\frac{Kd_{jk}}{Kd_{j1}} \geqq \alpha_j \tag{4}$$

wherein $Kd_{j1}$ represents the distribution coefficient of cement (i.e., represented by k=1).

In the case (1) of using a single solidifying agent component, the single solidifying agent used is not ordinarily conventional cement, such as Portland cement and blast furnace cement, namely $k \neq 1$. Although the distribution coefficients vary with respect to different solidifying agent components and radioactive nuclides, generally there is almost no nuclide dependence of the concentration ratio $\alpha_j$ obtained by volume reduction. In other words, $\alpha_j$ substantially has the same value with respect to any nuclide j.

EXAMPLE 1

In the case of solidifying a dried powder of Cs, which has been concentrated by 10 times by volume reduction, with sodium silicate, the condition of formula (4) holds and is represented as follows when the data of Table 2 is substituted:

$$\frac{90}{1} = 90 > 10 \quad (5)$$

Additionally, in the case of using a single solidifying agent component, the amount of Cs or Co leached is not reduced with any solidifying agent component shown in Table 2 as compared with that of a conventional cement-solidified waste. However, it is advantageous to reduce the elution ratio, as shown in Example 1, by paying special attention to $C_s$, which is a nuclide having a long half life.

(2) The case of using a solidifying agent comprising a plurality of mixed solidifying agent components In this case, the general formula corresponding to formula (4) is represented as follows:

$$\frac{Kd_{ja}W_a + Kd_{jb}W_b + \ldots}{Kd_{jl}} \geqq \alpha_j \quad (6)$$

wherein $Kd_{ja}$, $Kd_{jb}$ . . . represent the distribution coefficients of the respective solidifying agent components used: a (k=a), b (k=b), . . . ; $W_a$, $W_b$, . . . represent the mixing ratios by weights of the respective solidifying agent components; and the following relationship holds:

$$W_a + W_b + \ldots = 1 \quad (1)$$

EXAMPLE 2

In the case of solidifying a dried powder of Cs, which is concentrated by 10 times by volume reduction, with a solidifying agent obtained by mixing sodium silicate with cement, formula (6) is represented as follows:

$$\frac{Kd_{jl}W_l + Kd_{jb}W_b}{Kd_{jl}} \geqq 10 \quad (8)$$

wherein k=I means cement and k=b represents sodium silicate. Since $Kd_{jl}=1$ and $Kd_{jb}=90$ from Table 2, formula (78) is represented as follows:

$$W_l + \frac{90}{1} W_b \geqq 10 \quad (9)$$

Since $W_l+W_b=1$, if $W_l=0.89$ and $W_b=0.11$, the condition of formula (9) is represented by the following expression, and sufficiently holds:

$$0.89+90\times0.11=10.8>10$$

EXAMPLE 3

In the case of solidifying a dried powder of Co and Cs, which are concentrated by 10 times by volume reduction, with a solidifying agent obtained by mixing sodium silicate and oxine-added charcoal with cement, formula (6) relating to Co and Cs is represented as follows:

$$\frac{Kd_{jl}W_l + Kd_{jb}W_b + Kd_{jc}W_c}{Kd_{jl}} \geqq 10 \quad (10)$$

wherein k =1 means cement, k =b represents sodium silicate and k =c represents oxine-added charcoal. From the data of Table 2, $Kd_{jl}=1$, $Kd_{jb}=90$ and $Kd_{jc}=1$ with respect to Cs; and $Kd_{jl}=930$, $Kd_{jb}=600$ and $Kd_{jc}=27000$ with respect to Co, and the conditions of the following three formulas hold when the data is substituted:

$$W_l + \frac{90}{1} W_b + \frac{1}{1} W_c \geqq 10 \quad (11)$$

$$W_l + \frac{600}{930} W_b + \frac{27000}{930} W_c \geqq 10 \quad (12)$$

$$W_l + W_b + W_c = 1 \quad (13)$$

If $W_l=0.6$, $W_b=0.1$ and $W_c=0.3$ by solving the conditions of these three formulas, the formulas (11) and (12) hold and it is possible to greatly reduce the amount of Cs and Co leached as compared with that of a conventional cement-solidified waste.

In Example 1, the result of formula (5) is 90, which leaves too much margin for the limit 10. When a solidifying agent is expensive, for example, it is more desirable from the point of view of cost to use a satisfactory amount of solidifying agent as in Examples 2 and 3 than to leave too much margin.

In order to actually obtain the concentration ratio $\alpha_j$ in carrying out the present invention, a concentrated liquid waste is sampled from a storage tank or the supply tank and the concentration of the solid content (the portion which is to be powdered or pelletized as a result of the drying process) therein is measured, thereby calculating the concentration ratio $\alpha$ obtained by powdering and pelletization. As described above, there is actually almost no nuclide dependence of the concentration ratio o and, in fact, $\alpha_j$ takes almost the same value with respect to any nuclide j. In a standard concentrated liquid waste (the main ingredient is $Na_2SO_4$, 20 wt %), $\alpha=6$ to 8 in the case of powdering, and $\alpha=8$ to 10 in the case of pelletization. The nuclide concentration $C_j$ is determined by $\gamma$-ray measurement or by $\beta$-ray measurement at the time of the above-described sampling measurement.

A solidifying agent is prepared as a general rule by using the above-described formulas on the basis of the concentration ratio o obtained by measurement of the sampled liquid waste from the storage tank or the supply tank 1 (or from the drier 2) at every solidification process. Actually, however, since the concentration ratio o is substantially determined by the particular volume reduction process and the solidifying system that is used, as described above, it is more practical to use a solidifying agent prepared in advance that corresponds with that system. For example, $\alpha$ is about 10 in the case of pelletization, so a solidifying agent containing sodium silicate as the main ingredient is prepared in advance. An example thereof is the solidifying agent (called cement glass) prepared by mixing cement and sodium silicate described in Example 2.

As the noticeable nuclide j, the six nuclides shown in Table 2 are fundamentally selected, but it may be more convenient or practical to use one of the following three nuclides contained in a liquid waste.

| | | |
|---|---|---|
| Cs-137 | Representative nuclide generated due to the breakage of atomic fuel | Same group: $\alpha$ waste, Sr-90 |
| Co-60 | Representative nuclide generated due to corrosion | Same group: Ni-63 |
| C-14 | Not belonging to the above two groups | |

More simply, it is possible to select only Cs-137 as the noticeable nuclide which has a long half life (about 30 years) and radiates $\gamma$ rays, thereby facilitating measurement.

Additionally, it is more logical in actual execution of the present invention to take the concentration, the content, the half life, etc. of a nuclide into consideration as well as the concentration ratio $\alpha$ when selecting the solidifying agent components and the mixing ratio thereof. For example, even if the concentration of Co-60 (half period: 5.8 years) mixed with Cs-137 (half period: 30 years) is about 10 times as high as that of Cs-137, the concentrations of both nuclides are on the same level in about 20 years and thereafter Cs-137 has a higher concentration. Therefore, if the control period (300 years in Japan) of the final disposal facility is taken into consideration, it can be said to be more logical to select a solidifying agent while selecting Cs-137 as the noticeable nuclide.

Figure 3:
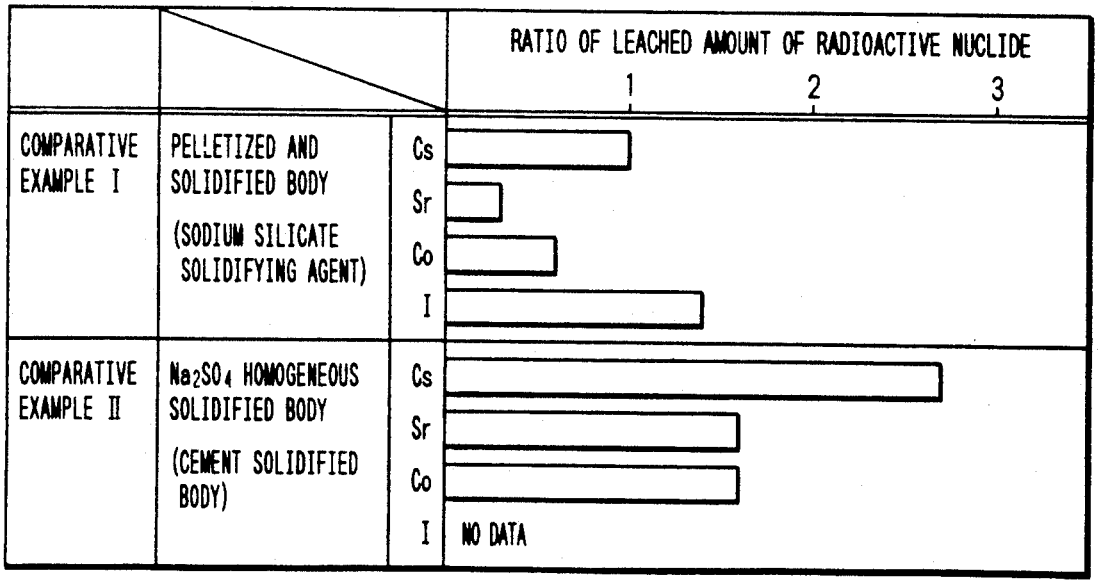
FIG. 3 is a graph showing a comparison between leaching ratios of solidified bodies processed according to the present invention and according to a conventional method.

In FIG. 3, a comparison is shown between the amounts of leaching of solidified wastes produced according to the present invention (Comparative Example I), and according to a conventional cement-solidified waste process (Comparative Example II). The amount of radioactive nuclide leached is represented as a value standardized on the basis of the amount of Cs leached in Comparative Example I as "1". The solidified waste in Comparative Example I is an embodiment of the present invention produced by drying a concentrated liquid waste to form powder, pelletizing the powder and solidifying the pellets with sodium silicate as a solidifying agent, while the solidified waste in Comparative Example II is a conventional cement-solidified waste produced by homogeneously solidifying a concentrated liquid waste with cement as the solidifying agent without first subjecting the waste to volume reduction processing. It is clear that according to the embodiment of the present invention, the effect of preventing leaching of the solidified waste is superior to that of the conventional cement-solidified waste.

Further in accordance with another embodiment of the invention, the solidifying agent can be prepared so that the amount of leaching for the solidified body is restricted to a permitted value, such as one generally considered acceptable by the industry or set by an ordinance.

If a permitted amount of leaching of a radioactive nuclide j is $P_j$ (Ci/year·ton) and the radioactive concentration of the nuclide is $C_j$ (Ci/ton), and the distribution coefficient of the solidifying agent with respect to the nuclide j is $Kd_{jk}$, the condition of the following formula must hold in order that the permitted value is not exceeded.

$$P_j \geqq \frac{C_j}{Kd_{jk}} \times A \tag{14}$$

That is, for keeping the amount of leaching nuclide lower than the permitted amount, the distribution coefficient of the solidifying agent must satisfy the condition of the following formula.

$$Kd_{jk} \geqq \frac{C_j}{P_j} \times A \tag{15}$$

wherein A is a value determined by several factors, including the proportion of the solidifying agent and radioactive waste contained in the container, the density of the solidifying agent, and so forth. Assuming that the amount of leaching nuclide is regulated by the distribution balance between the nuclide and the solidifying agent, the value A is obtained by the following formula:

$$A = 1/(r \times \rho) \tag{16}$$

Wherein r is a proportion of the solidifying agent in the solidified radioactive waste in the container, and $\rho$ is the density of the solidifying agent.

The radioactive concentration Cj in the solidified radioactive waste may be estimated beforehand by the radioactive concentration of the nuclide j in the tank and the concentration ratio $\alpha$. In the case of solidifying radioactive waste with a solidifying agent obtained by mixing more than two solidifying agent components together, the solidifying agent may be prepared on a way similar to that practiced when meeting the conditions of formulas (6) and (7). That is, the solidifying agent is prepared by using the following formulas:

$$(Kd_{ja}\, W_a + Kd_{jb}\, W_b + \ldots) \geqq \frac{C_j}{P_j} \times A \tag{17}$$

$$W_a + W_b + \ldots = 1 \tag{18}$$

Further, in the case of a radioactive waste having a plurality of noticeable nuclides, the solidifying agent may also be prepared in the same way as disclosed in Example 3.

Example 4

An example in which the noticeable nuclide is Cs-137 will be explained.

The permitted amount of leaching nuclide of Cs-137 is assumed to be 0.3 Ci/year·to". The radioactive concentration of Cs-137 and the concentration of the solids content in the tank 1 are measured in a conventional manner. The concentration ratio $\alpha$ is obtained in accordance with the measured concentration of the solids content and in consideration of the particular concentration steps, e.g., the drying and pelletizing steps.

Therefore, if the measured radioactive concentration in the tank 1 is 2 Ci/ton and the concentration ratio $\alpha$ is 5, the radioactive concentration of Cs-137 in the solidified radioactive waste is estimated to be 10 Ci/ton.

Next, if the proportion of the solidifying agent in the container is 0.45 and the density of the solidifying agent (e.g., the mixture of cement and sodium silicate) is 1.7 ton/m$^3$ (the density of the inorganic solidifying agent, e.g., cement or sodium silicate is about 1.5–2.5 ton/m$^3$) the value of A becomes 1.3 (m$^3$/ton·y) according to formula (14).

Therefore, the distribution coefficient of the solidifying agent must be larger than the following value.

$$\frac{C_j}{P_j} A = \frac{10 \times 1.3}{0.3} = 44$$

The solidifying agent component is selected based upon the distribution coefficients shown in Table 2. If sodium silicate (50 wt%) and cement (50 wt%) are selected and mixed, the distribution coefficient is 46. Therefore, the mixture thus produced satisfies the condition that the amount of leached nuclide be less than the permitted level.

Although in the examples of an embodiment of the invention given above, the liquid waste is concentrated by drying and forming the waste into a powder, pelletizing the powder, and solidifying the powder or pellets with a solidifying agent, the method and apparatus of the present invention are not restricted to these examples, but is also applicable to the volume reduction and solidification of a used ion-exchanged resin slurry that is concentrated into a liquid waste sludge. As a result or the present invention, it is possible to increase the amount of radioactive waste that can be charged into a solidified waste container since solid waste having a higher volume reduction ratio than that of conventional cement-solidified waste is contained within the container. As a result, overhead expenses incurred with respect to the waste disposal cost and storage thereof are reduced.

While a preferred embodiment has been described with variations, further embodiments, variations and modifications are contemplated within the spirit and scope of the following claims.

We claim:

1. A method of solidifying a radioactive waste having at least one radioactive nuclide j with solidifying agent to produce a solidified radioactive waste, comprising:

concentrating the radioactive waste to reduce its volume and produce a concentrated radioactive waste;

determining a concentration ratio $\alpha$ representing a reduction in volume of the waste resulting from said concentrating;

before said concentrating, determining a value of radioactive concentration of the radioactive waste that is to be solidified;

calculating a radioactive concentration $C_j$ for said radioactive nuclide j of the solidified radioactive waste as a product of the concentration ratio $\alpha$ and the value of radioactive concentration of the radioactive waste that is to be solidified;

adjusting a distribution coefficient of the solidifying agent in accordance with the radioactive concentration $C_j$ of said calculating and mixing together at least two solidifying agent components selected according to their respective distribution coefficients from a plurality of solidifying agent components having different distribution coefficients so that an amount of leaching of the solidified radioactive waste is smaller than or equal to a fixed predetermined value; and filling a container with the solidifying agent and the concentrated radioactive waste whereby after hardening the solidified radioactive waste is produced.

2. A method of solidifying a radioactive waste according to claim 1, wherein said adjusting adjusts the distribution coefficient according to a result of said calculating so that the amount of leaching is smaller than that f a solidified radioactive waste that is solidified with only cement and without the concentrating step being performed to produce a solidified body equivalent in quantity to said solidified radioactive waste.

3. A method according to claim 1, wherein said radioactive waste is a radioactive liquid waste and said concentrating includes drying the radioactive liquid waste and converting it into the form or a powder.

4. A method of solidifying a radioactive waste according to claim 1, wherein said radioactive waste is a radioactive resin slurry and said concentrating includes drying the radioactive resin slurry and converting it into the form of a powder.

5. A method according to claim 3, wherein said concentrating step further includes pelletizing said powder.

6. A method of solidifying a radioactive waste according to claim 4, wherein said concentrating further includes pelletizing said powder.

7. A method of solidifying a radioactive waste according to claim 1, wherein said radioactive waste is a radioactive liquid waste and said concentrating includes processing said concentrated radioactive liquid waste into the form of a sludge.

8. A method of solidifying radioactive waste according to claim 1, wherein said mixing includes mixing together at least two of cement, sodium silicate, zeolite, bentonite, calcium salt and oxine-added charcoal as said at least two solidifying agent components.

9. A method of solidifying a radioactive waste according to claim 1, wherein said waste includes a plurality of radioactive nuclides, and said determining a value, said calculating and said adjusting are performed for each radioactive nuclide.

10. A method of solidifying a radioactive waste according to claim 1, wherein said mixing includes selecting the solidifying agent components in accordance with the type of radioactive nuclide that is present in the radioactive waste and mixing the selected solidifying agent components together in predetermined proportion to produce said solidifying agent.

11. A method of solidifying radioactive waste according to claim 9, wherein said adjusting adjusts the distribution coefficient of the solidifying agent so that the amount of leaching is smaller than that of a solidified radioactive waste that is solidified only with cement and without first being concentrated to produce a solidified body equivalent in quantity to said solidified radioactive waste.

12. A method of solidifying radioactive waste according to claim 9, wherein said plurality of radioactive substances in said radioactive waste is selected from the group consisting of Carbon 14, Cobalt 60, Cesium 137, Strontium 90, Nickel 63 and substances radiating $\alpha$ rays.

13. A method of solidifying a radioactive waste having at least one radioactive nuclide j with a solidifying agent to produce a solidified radioactive waste, comprising:

concentrating the radioactive waste to reduce its volume and produce a concentrated radioactive waste;

calculating before said concentrating step an anticipated concentration of what the concentrated radioactive waste will be after the concentrating step;

adjusting a distribution coefficient of the solidifying agent in accordance with a result of said calculating by selecting and mixing together at least two solidifying agent components selected according to their respective distribution coefficients from a plurality of solidifying agent components having different distribution coefficients so that an amount of leaching of the solidified radioactive waste is smaller than or equal to a predetermined value;

charging the concentrated radioactive waste into a container; and pouring the solidifying agent into the container to fill the container and cover the concentrated radioactive waste whereby after hardening the solidified radioactive waste is produce;

wherein said calculating includes determining a concentration radio $\alpha$ representing a reduction in volume of the waste resulting from said concentrating based on said anticipated concentration of the concentrated radioactive waste and calculating a radioactive concentration $C_j$ for the radioactive nuclide j of the solidified radioactive waste as a product of the concentration ratio $\alpha$ and a measured value of radioactive concentration of the radioactive waste that is to be solidified.

14. A method of solidifying a radioactive waste having at least one radioactive nuclide with a solidifying agent to produce a solidified radioactive waste, comprising the steps of:

concentrating the radioactive waste to reduce its volume and produce a concentrated radioactive waste;

calculating before said concentrating step an anticipated concentration of what the concentrated radioactive waste will be after the concentrating step;

adjusting a distribution coefficient of the solidifying agent in accordance with a result of said calculating by selecting and mixing together at least two solidifying agent components selected according to their respective distribution coefficients from a plurality of solidifying agent components having different distribution coefficients so that an amount of leaching of the solidified radioactive waste is smaller than or equal to a predetermined value;

charging the concentrated radioactive waste into a container; and pouring the solidifying agent into the container to fill the container and cover the concentrated radioactive waste whereby after hardening the solidified radioactive waste is product;

wherein said distribution coefficient of the solidifying agent is adjusted to meet a condition expressed as follows:

$$\frac{Kd_{jk}}{Kd_{j1}} \geqq \alpha_j$$

wherein $Kd_{j1}$ represents a distribution coefficient for cement with respect to radioactive nuclide j, $Kd_{jk}$ represents a distribution coefficient of a solidifying agent k with respect to radioactive nuclide j, and $\alpha_j$ is a concentration ratio representing a reduction in volume resulting from said concentrating of the solidified waste containing radioactive nuclide j based on said anticipated concentration of the radioactive waste.

15. A method of solidifying a radioactive waste with a solidifying agent to produce a solidified radioactive waste, comprising the steps of:

concentrating the radioactive waste to reduce its volume and produce a concentrated radioactive waste; calculating before said concentrating step an anticipated concentration of what the concentrated radioactive waste will be after the concentrating step;

adjusting a distribution coefficient of the solidifying agent in accordance with a result of said calculating by selecting and mixing together at least two solidifying agent components selected according to their respective distribution coefficients from a plurality of solidifying agent components having different distribution coefficients so that an amount of leaching of the solidified radioactive waste is smaller than or equal to a predetermined value;

charging the concentrated radioactive waste into a container; and pouring the solidifying agent into the container to fill the container and cover the concentrated radioactive waste whereby after hardening the solidified radioactive waste is produced;

wherein said distribution coefficient of the solidifying agent is adjusted to meet a condition expressed as follows:

$$\frac{Kd_{ja}W_a + Kd_{jb}W_b + \ldots}{Kd_{j1}} \alpha_j,$$

wherein $Kd_{ja}$, $Kd_{jb}$ . . . represents the respective distribution coefficients of the solidifying agent components k with respect to radioactive nuclides ja, jb . . . used: a(k=a), b (k=b), . . . , $W_a$, $W_b$, . . . represent the respective mixing ratios by weights of the solidifying agent components; and the following relationship holds $$W_a + W_b + \ldots = 1,$$

and wherein $\alpha_j$ is the concentration ratio representing a reduction in volume resulting from said concentrating of the solidified waste containing radioactive nuclide j based on said anticipated concentration of the radioactive waste.

* * * * *